US010773934B2

(12) United States Patent
Fanello et al.

(10) Patent No.: US 10,773,934 B2
(45) Date of Patent: Sep. 15, 2020

(54) MACHINE HAVING HOISTING SYSTEM WITH INSTRUMENTED FAIRLEAD

(71) Applicant: Caterpillar Inc., Deerfield, IL (US)

(72) Inventors: Shawn Philip Fanello, Chillicothe, IL (US); Jason Louis Smallenberger, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 267 days.

(21) Appl. No.: 15/984,641

(22) Filed: May 21, 2018

(65) Prior Publication Data

US 2019/0352148 A1 Nov. 21, 2019

(51) Int. Cl.

| | |
|---|---|
| ***B66C 23/90*** | (2006.01) |
| ***B66C 13/16*** | (2006.01) |
| ***B66C 23/44*** | (2006.01) |
| ***B66D 1/36*** | (2006.01) |
| ***B66C 15/06*** | (2006.01) |
| ***B66C 9/00*** | (2006.01) |

(52) U.S. Cl.

CPC ..... *B66C 23/90* (2013.01); *B66C 9/00* (2013.01); *B66C 13/16* (2013.01); *B66C 15/06* (2013.01); *B66C 23/44* (2013.01); *B66D 1/36* (2013.01); *B66C 2700/0357* (2013.01)

(58) Field of Classification Search

CPC ..... B66C 23/00; B66C 23/06; B66C 23/36; B66C 23/44; B66C 23/90; B66C 23/905; B66C 15/06; B66C 15/065; B66C 13/00; B66C 13/16; B66C 13/18; B66C 13/22; B66C 9/00; B66D 1/36

See application file for complete search history.

(56) References Cited

U.S. PATENT DOCUMENTS 2,022,844 A * 12/1935 Christian ..... B66C 23/90 212/283
2,425,663 A * 8/1947 Wooldridge ..... B66C 23/36 212/288
2,722,320 A * 11/1955 Carlson ..... B66C 23/76 212/196
3,005,559 A * 10/1961 Toderick ..... B66C 23/72 212/280
3,055,511 A * 9/1962 Sharp ..... B66C 23/44 212/258
3,058,600 A * 10/1962 Gosnell ..... B66C 23/44 212/203
3,265,220 A * 8/1966 Knight ..... B66C 23/90 212/278
3,269,560 A * 8/1966 Knight ..... B66C 23/905 212/278

(Continued)

*Primary Examiner* — Michael R Mansen
*Assistant Examiner* — Juan J Campos, Jr.

(57) ABSTRACT

A hoisting system for a machine includes a winch assembly, and a boom such as a sideboom that is pivotable. The hoisting system further includes a fairlead supported at a fixed orientation such that a feed angle of a hoisting cable extending through the fairlead varies in response to pivoting of the boom. A hoisting control system for the machine includes a cable state sensing mechanism resident on the fairlead and structured to produce cable monitoring data indicative of at least one of a cable feed length, a cable feed angle, or a cable load, and an electronic control unit structured to output an alert based on the cable monitoring data.

10 Claims, 5 Drawing Sheets

(56) References Cited

U.S. PATENT DOCUMENTS 3,278,925 A * 10/1966 Saunders ..... G08B 5/02 340/522
3,329,283 A * 7/1967 Wade ..... B66C 23/44 212/300
3,357,571 A * 12/1967 Boughton ..... B66C 23/90 212/277
3,426,915 A * 2/1969 Tesch ..... B66C 23/44 212/300
3,479,984 A * 11/1969 DeLuca, Jr. ..... B66C 23/90 33/370
3,708,152 A * 1/1973 Bulin ..... B66D 1/36 254/327
3,815,478 A * 6/1974 Axelsson ..... B66D 1/08 91/497
3,912,230 A * 10/1975 Learmont ..... B66D 1/36 254/336
4,132,317 A * 1/1979 Arendt ..... B66C 23/76 180/9.48
4,143,856 A * 3/1979 Morrow, Sr. ..... E02F 3/48 192/3.25
4,172,688 A * 10/1979 Cecchi ..... B66C 23/90 116/284
5,332,110 A * 7/1994 Forsyth ..... B66C 23/44 212/196
5,392,936 A 2/1995 Solomon et al.
5,992,655 A * 11/1999 Greenberg ..... B66C 23/44 212/258
6,000,563 A 12/1999 Greenberg
8,152,412 B2 4/2012 Davis
8,783,477 B2 7/2014 Camacho et al.
2004/0033109 A1* 2/2004 Gelmi ..... B66C 23/44 405/174
2004/0190995 A1* 9/2004 Matsushita ..... F16L 1/036 405/174
2006/0245888 A1* 11/2006 Dietz ..... B66C 23/44 414/563
2009/0297275 A1* 12/2009 Davis ..... F16L 1/028 405/174
2016/0060082 A1* 3/2016 Huang ..... B66D 1/44 700/213
2016/0207744 A1* 7/2016 Uemura ..... B66D 1/36
2019/0023538 A1* 1/2019 Pletz ..... B66C 23/42
2019/0031474 A1* 1/2019 Stilborn ..... G01M 13/04
2019/0033158 A1* 1/2019 Bonnet ..... G01M 1/14
2019/0337776 A1* 11/2019 Fanello ..... B66C 23/44

* cited by examiner

MACHINE HAVING HOISTING SYSTEM WITH INSTRUMENTED FAIRLEAD

TECHNICAL FIELD

The present disclosure relates generally to a machine equipped with a sideboom and a fairlead for guiding a hoisting cable to and from the sideboom, and more particularly to such a machine where the fairlead is instrumented with a cable state sensing mechanism.

BACKGROUND

Pipelayers are specialized machines used to suspend and place pipelines in a prepared trench or the like. A typical pipelayer includes a load manipulating boom positionable outwardly from the side of the machine in a direction generally perpendicular to a forward travel direction. It is common for a cable and rigging system to be provided for manipulating the position of the boom, as well as a load suspended by the boom adjacent to or within a trench. It is also typical for pipelayers to operate in teams with a group of the machines operating in a coordinated fashion, to each support a different section of pipe as the pipe is gradually placed into a trench. In some instances the pipe sections are welded together as they are suspended by the pipelayer machines. Pipelayer teams often require precise and concerted efforts not only for successful placement but also to optimize speed and efficiency and protect operators and ground crew personnel.

Due to the nature of pipeline placement and support of pipe sections out to the side of the machine, there can be challenges to stably supporting the suspended load without risking tipping the machine. These challenges can be particularly acute in poor underfoot conditions, as well as steep terrain. To enhance stability most pipelayer machines are equipped with a counterweight positioned opposite the sideboom, and which can be adjusted to compensate for adjustments in the height and positioning of a suspended load. One example pipelayer machine is known from U.S. Pat. No. 8,783,477 to Camacho et al. It will be appreciated that a significant degree of operator skill can be required to control the speed and travel direction of a pipelayer machine while also monitoring and adjusting the suspension height of the load and positioning of the supporting sideboom. The availability of skilled operators, as well as ground crew, at worksites that are often remote has long challenged the industry. For these and other reasons, continued advancements and improvements to develop and exploit technological solutions in the pipelayer field are desirable.

SUMMARY OF THE INVENTION

In one aspect, a machine includes a frame, and a hoisting system coupled to the frame and including a winch assembly. The hoisting system further includes a boom movable by pivoting between a first boom position, and a second boom position at which the boom extends outboard of the frame. The hoisting system further includes a fairlead, and a hoisting cable extending through the fairlead from the winch assembly to the boom. The fairlead is supported at a fixed orientation relative to the frame, such that a feed angle of the hoisting cable between the fairlead and the boom varies in response to the pivoting of the boom between the first boom position and the second boom position. The machine further includes a hoisting control system having a cable state sensing mechanism resident on the fairlead and structured to produce cable monitoring data indicative of at least one of a cable feed length, a cable feed angle, or a cable load, and an electronic control unit coupled with the cable state sensing mechanism and structured to output an alert based on the cable monitoring data.

In another aspect, a fairlead system for a machine includes a fairlead having a first end forming a fairlead base having a mounting surface, for mounting the fairlead to a frame in a machine, and a second end, and defining a longitudinal fairlead axis extending between the first end and the second end. The fairlead further includes a feed pulley, for feeding a hoisting cable through the fairlead between a winch assembly and a pivotable boom and the machine. A cable state sensing mechanism is resident on the fairlead and structured to produce cable monitoring data indicative of at least one of a cable feed length, a cable feed angle, or a cable load, and instrumentation circuitry for connecting the cable state sensing mechanism to an electronic control unit in a hoisting control system in the machine.

In still another aspect, a method of operating a machine includes guiding a hoisting cable between a winch assembly and a boom in the machine by way of a fairlead supported at a fixed orientation relative to a frame of the machine, and pivoting the boom between a first boom position and a second boom position relative to the frame. The method further includes producing cable monitoring data from a cable state sensing mechanism resident on the fairlead. The cable monitoring data is indicative of a change to at least one of a cable feed length, a cable feed angle, or a cable load that occurs in response to the pivoting of the boom between the first boom position and the second boom position. The method still further includes outputting an alert based on the cable monitoring data.

DETAILED DESCRIPTION

Figure 1:
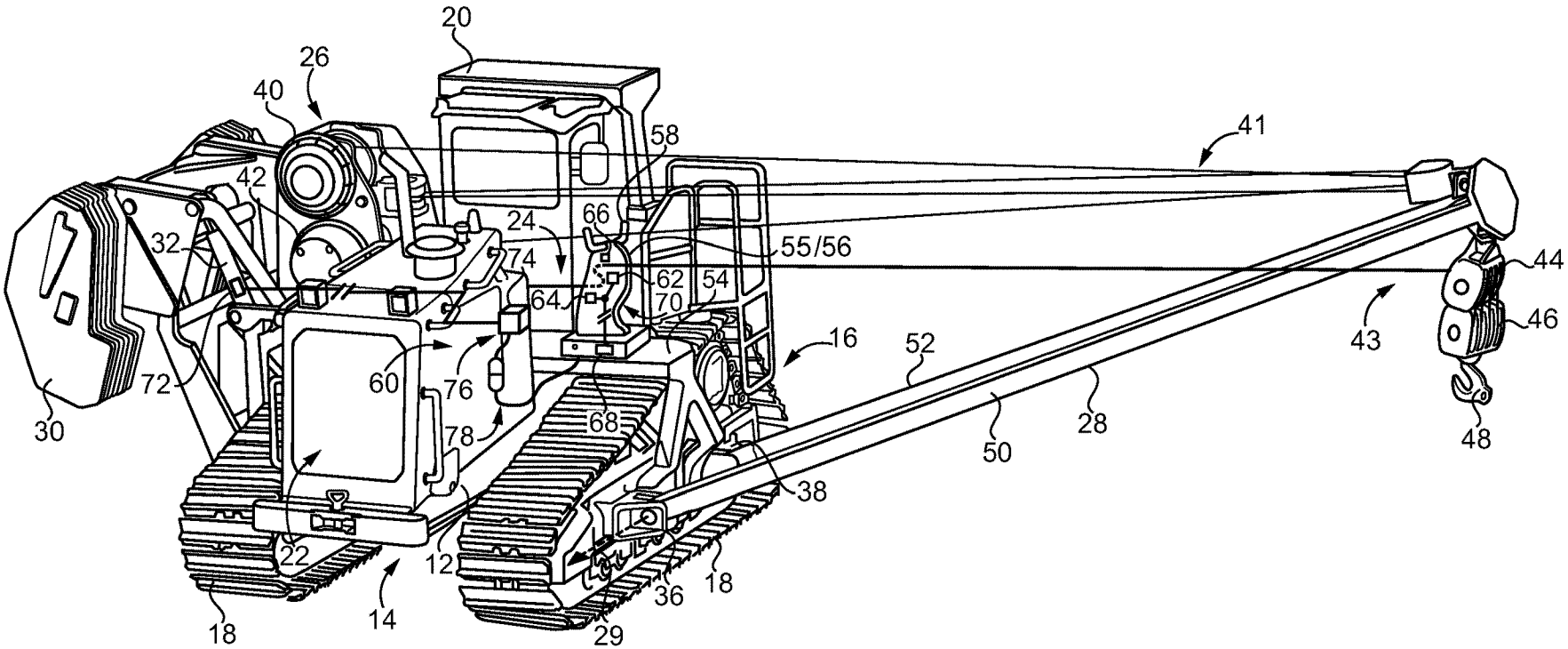
FIG. 1 is a diagrammatic view of a machine, according to one embodiment.

Referring to FIG. 1, there is shown a ground-engaging machine 10 according to one embodiment, and structured as a pipelayer machine for transporting, suspending, and placing pipe sections of a pipeline according to generally known practices. Machine 10 includes a frame 12 having a front frame end 14 and a back frame end 16. An engine system 22 is mounted adjacent to front frame end 14 in the illustrated embodiment. An operator station 20, such as an operator cab, is coupled to and mounted upon frame 12 between front frame end 14 and back frame end 16. Ground-engaging elements 18, including tracks in the illustrated embodiment, are coupled to and positioned upon opposite sides of frame 12. Machine 10 further includes a counterweight 30 positioned upon one side of frame 12 and adjustable by way of one or more counterweight actuators 32 in a generally conventional manner.

Machine 10 further includes a hoisting system 24 coupled to frame 12 and including a winch assembly 26, and a boom 28 movable by pivoting between a first boom position, and a second boom position, at which boom 28 extends outboard of frame 12. Boom 28 may include a sideboom, and is pivotable about a sideboom pivot axis 29 having a fixed orientation and extending in a fore-to-aft direction relative to frame 12. Boom 28 may be oriented substantially vertically at the first boom position, and oriented approximately as shown in FIG. 1 outboard of frame 12 at the second boom position. Boom 28 (hereinafter "sideboom 28") may be structured for lowering further than what is shown in FIG. 1, to or below a horizontal plane in certain embodiments. Those skilled in the art will be familiar with positioning and adjustment of a counterweight such as counterweight 30 to offset a load supported by way of a sideboom, such as a length of pipe. In an implementation, sideboom 28 may be coupled to frame 12 at each of a forward location and a rearward location by way of a forward connector 36 and a rearward connector 38, respectively. Sideboom 28 may further include a first or forward beam 50 and a second or rearward beam 52 coupled with forward connection 36 and rearward connection 38, respectively, and arranged in a generally triangular pattern. Other sideboom designs and configurations could be employed in different embodiments. Hoisting system 24 further includes an upper hook pulley block 44 supported by sideboom 28, a lower hook pulley block 46 suspended below upper hook pulley block 44, and a hook 48. A hoisting cable 43 may be attached to hook 48 and extends through lower hook pulley block 46 and upper hook pulley block 44, with lower hook pulley block 46 suspended by hoisting cable 43. Hoisting cable 43 can also extend to a winch 42 in winch assembly 26. Hoisting cable 43 may be attached to and wrap about a winding drum or the like of winch 42 to enable raising and lowering of hook 48. Another winch 40 of winch assembly 26 can include another winding drum or the like that is attached to and winds one or more boom cables 41 structured for raising and lowering sideboom 28 in a generally known manner.

Hoisting system 24 further includes a fairlead system 55 including a fairlead 56. Hoisting cable 43 extends through fairlead 56 from winch assembly 26 to sideboom 28. Fairlead 56 is supported at a fixed orientation relative to frame 12, such that a feed angle of hoisting cable 43 between fairlead 56 and sideboom 28 varies in response to the pivoting of sideboom 28 between the first boom position and the second boom position. Fairlead 56 may be positioned at a fairlead mounting location longitudinally between front frame end 14 and back frame end 16, and latitudinally between winch assembly 26 and sideboom 28. The fairlead mounting location may be both forward and outboard of operator station/cab 20. It can also be noted from FIG. 1 that fairlead 56 is mounted upon a centerframe beam 54 that extends latitudinally across frame 12 generally between engine system 22 and operator station/cab 20. Centerframe beam 54 can further be coupled with a track roller frame or the like (not numbered) supporting one of ground-engaging elements 18, by way of forward connection 36 and rearward connection 38.

Machine 10 further includes a hoisting control system 60 having a cable state sensing mechanism 62, 64, 66, resident on fairlead 56. The cable state sensing mechanism 62, 64, 66 can include one or more sensors 62, 64, 66 structured to produce cable monitoring data indicative of at least one of a cable feed length, a cable feed angle, or a cable load. Hoisting control system 60 also includes an electronic control unit 74 coupled with the cable state sensing mechanism 62, 64, 66 and structured to output an alert responsive to the cable monitoring data.

Figure 2:
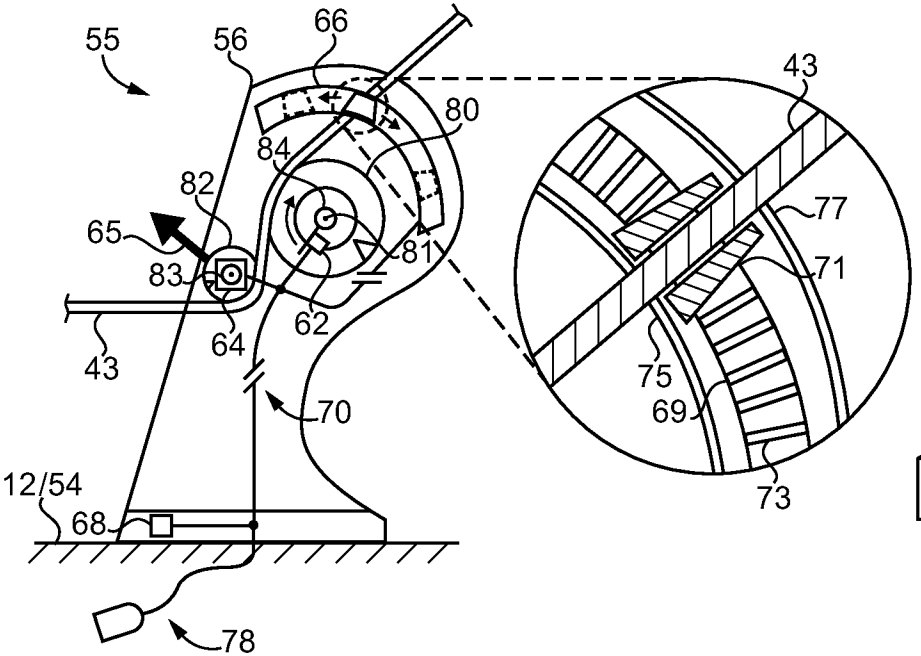
FIG. 2 is a diagrammatic view of a fairlead system, including a detailed enlargement, according to one embodiment.

Referring also now to FIG. 2, fairlead 56 further includes a plurality of feed pullies, including a first feed pulley 80 rotatable about a first axis 81, and a second feed pulley 82 rotatable about a second axis 83. Hoisting cable 43 may extend about feed pullies 80 and 82 in a serpentine pattern, meaning that hoisting cable 43 changes direction at least twice, in opposite directions. Also shown in FIG. 2 are additional details relating to the cable state sensing mechanism 62, 64, 66 which may be coupled with or part of electrical instrumentation circuitry 70 resident on fairlead 56. As used herein, the term "circuitry" should be understood to include electrical connectors, wiring, circuit elements, or any of the various sensors contemplated herein. Wiring alone is not fairly understood to be circuitry. A wiring harness 78 is coupled with or part of instrumentation circuitry 70, and structured to connect with hoisting control circuitry 76 on machine 10. Hoisting control circuitry 76 can include or be connected with a counterweight position sensor 72 associated with counterweight actuator 32, and also includes or is electrically connected with electronic control unit 74.

Figure 5:
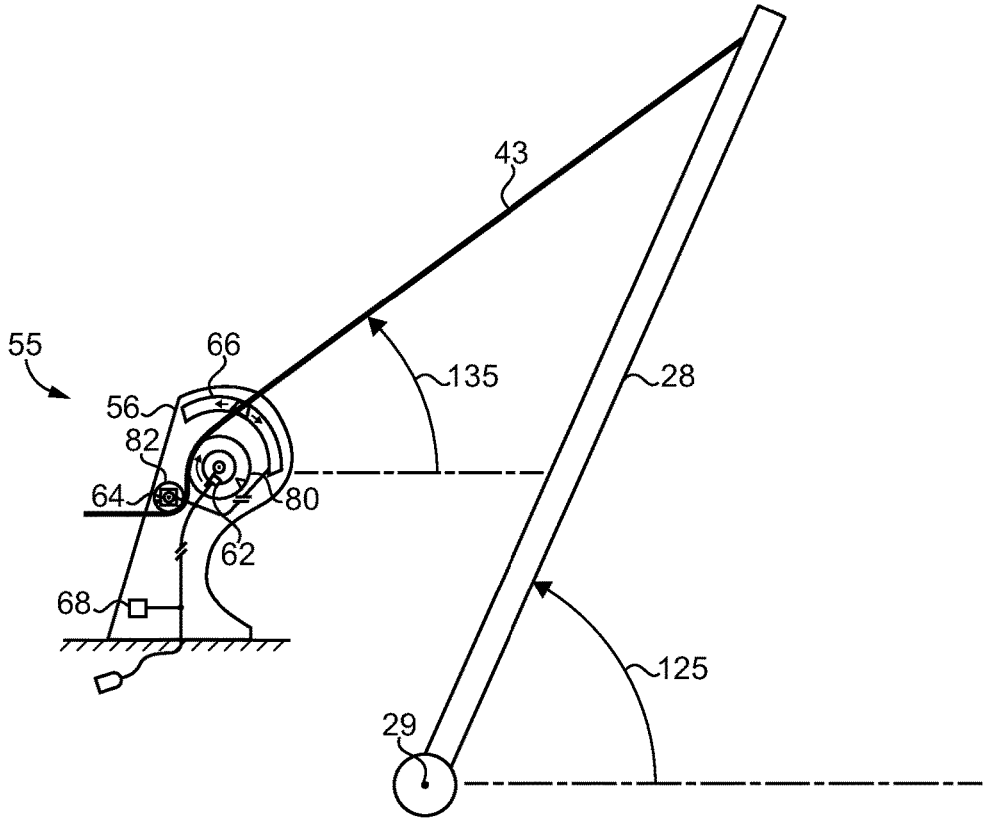
FIG. 5 is a diagrammatic view of parts of a hoisting system in a first configuration.

As noted above, the cable state sensing mechanism 62, 64, 66 can include one or more sensors, in one implementation a cable angle sensor 66. Electronic control unit 74 may further be structured to determine an angle of sideboom 28 based on the cable monitoring data produced by cable angle sensor 66, as further discussed herein. The cable state sensing mechanism 62, 64, 66 may additionally or alternatively include a load sensor 64, and electronic control unit 74 may be further structured to determine a hook load based on the cable monitoring data produced by load sensor 64. In a further implementation, feed pulley 82 can include a pulley pin 84, and load sensor 64 may include a strain gauge coupled with pulley pin 84. A force vector 65 is also depicted in FIG. 5, and represents an example force exerted by tensioned hoisting cable 43 on feed pulley 82. Contact between hoisting cable 43 and feed pulley 82, and strain on pulley pin 84, enables load sensor 64 to produce the cable monitoring data that is indicative of a load on hoisting cable 43. Because load or tension on hoisting cable 43 can vary with an orientation of sideboom 28, electronic control unit 74 can be structured to determine the actual current load or hook load based upon both the observed load on hoisting cable 43 as indicated by raw data produced by load sensor 64, and the orientation of sideboom 28. As an alternative to a strain gauge, a different type of load sensor might be used such as a position sensor coupled with a displaceable mechanism such as a gas spring, a mechanical spring, or an otherwise deformable or deflectable mechanism. Position and/or orientation sensors contemplated herein could include rotary or linear potentiometers, Hall effect sensors, inductive or capacitive sensors, optical sensors, or still another type. The cable state sensing mechanism 62, 64, 66 may also include a cable feeding sensor 62, and electronic control unit 74 may be structured to determine a cable feed length through fairlead 56 based on the cable monitoring data produced by cable feeding sensor 62. Cable feeding sensor 62 may include a pulley rotation counter, as further discussed herein. A body or frame sensor 68 which can produce data indicative of a position or orientation of frame 12 can also be resident on fairlead 56, with pitch, roll, and yaw being monitored by sensor 68. In a practical implementation strategy, sensor 68 can include an initial measurement unit or IMU.

FIG. 2 also includes a detailed enlargement illustrating additional features of cable angle sensor 66, including a collar 71 positioned upon and extending circumferentially about hoisting cable 43. It will be appreciated that hoisting cable 43 can feed in and out from fairlead 56 at a varying feed angle, through collar 71. Collar 71 may be free to rotate with an upward and downward movement of hoisting cable 43 that occurs in response to the pivoting of sideboom 28. Collar 71 may also be restricted from moving in and out with the feeding of hoisting cable 43 by way of an inboard stop 75 and an outboard stop 77. Each of stop 75 and stop 77 can have a generally arcuate form and be positioned in fairlead 56 such that collar 71 contacts stop 77 if hoisting cable 43 is fed outward, and contacts stop 75 if hoisting cable 43 is fed inward. Collar 71 can be understood as a sensor target, with a sensor body 69 being supported at a fixed location and orientation in fairlead 56. A sensor or sensor body coupled to one of fairlead 56 and hoisting cable 43, and a sensor target coupled to the other of fairlead 56 and hoisting cable 43 provides a practical implementation strategy, although those skilled in the art will appreciate a variety of other ways of sensing cable angle. Electromagnetic pickups 73 or the like can be located upon sensor body 69 to enable detection of proximity of sensor target/collar 71 and thereby output the cable monitoring data indicative of cable angle, the significance of which will be further apparent from the following description.

Figure 3:
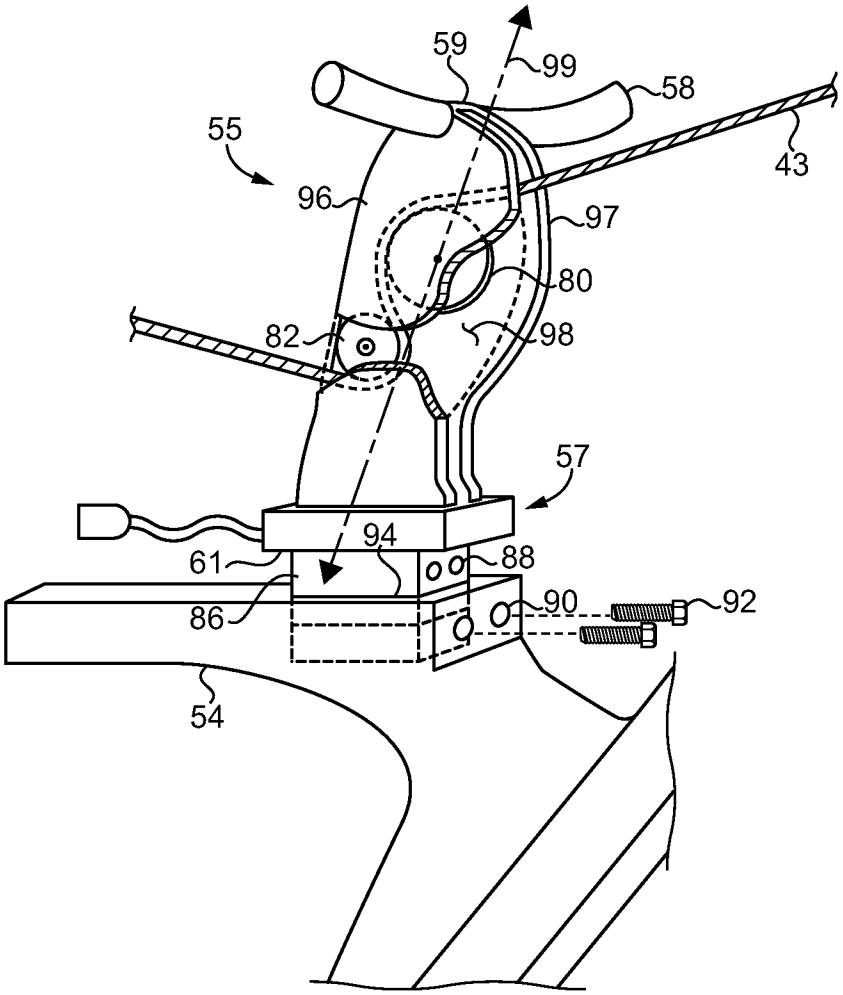
FIG. 3 is a partially open side diagrammatic view of a fairlead system shown as it might appear ready for installation on a centerframe beam of a machine, according to one embodiment.

Referring also now to FIG. 3, there is shown fairlead system 55 and illustrating fairlead 56 partially open and in further detail. Fairlead 56 can include a first fairlead end 57 forming a base and a second fairlead end 59 that includes a cable guide 58. A mounting surface 61 is formed on first fairlead end/base 57. In the illustrated embodiment, fairlead 56 includes a post 86 extending downwardly from first fairlead end 57 and having a plurality of bolting holes 88 formed therein. In FIG. 3 post 86 is shown as it might appear being inserted into an aperture 94 formed in centerframe beam 54. A plurality of bolting holes 90, which can register with bolting holes 88 formed in centerframe beam 54, are structured to receive bolts 92 to attach fairlead 56 in place upon centerframe beam 54. It will be appreciated that fairlead system 55 could be installed by way of another strategy, such as an alternative bolting strategy with horizontally oriented bolts, by welding to a centerframe beam or another frame component, or by still another construction. FIG. 3 also illustrates a first sideplate 96 and a second sideplate 97 of fairlead 56, defining a through-channel extending therebetween. It can be seen that each of pulley 80 and pulley 82 is supported at least partially within through-channel 98. A longitudinal fairlead axis 99 extends between first end 57 and second 59. Certain prior strategies for monitoring machine position, boom position, and other properties attempted to place instrumentation such as position sensors directly on a machine boom. In the case of a pipelayer machine, for example, the boom is often removed for transport, necessitating breaking of electrical connections, and reestablishing electrical connections when the machine is prepared for returning to service after transport. An instrumented fairlead can maintain all the instrumentation onboard the machine without such drawbacks. It is further contemplated that a replacement fairlead system according to the present disclosure could be provided as an aftermarket component providing the foregoing and other advantages to existing machines already in the field. Fairlead system 55 can thus be bolted-on or welded-on in place of an existing fairlead, or provided as original equipment.

It will also be recalled that cable feeding sensor 62 produces cable monitoring data indicative of a cable feed length through fairlead 56. In one embodiment, cable feeding sensor 62 can be structured as a rotation counter to output the cable monitoring data each time pulley 80 completes a rotation in a first direction. Cable feeding sensor 62, or another sensor (not shown), could output a cable infeed signal each time pulley 80 completes a rotation in an opposite direction. An electronic proximity sensor, an electromechanical switch, or still other strategies could be used, such as an arrangement of sensor targets on pulley 80 that are sensed to indicate rotation in one direction by way of a first pattern rotated past a sensor and indicate rotation in an opposite direction by way of a reverse pattern rotated past the sensor.

Those skilled in the art will be familiar with the phenomenon of pulley block collision, and its potential risks of straining a hoisting cable or causing other problems. A location of the normally stationary upper hook pulley block 44 in space can be determined on the basis of fixed boom geometry and sideboom angle, which is directly proportional to cable feed angle. A location of lower hook pulley block 46 can be determined on the basis of a length of hoisting cable 43 fed through fairlead 56, with a number of pulley revolutions in a feeding-out direction being proportional to a cable feed length. It will also be recalled that sensor 68 may be resident on fairlead 56. Electronic control unit 74 can receive data from sensor 68 indicative of an orientation of frame 12, and thus machine 10. Based upon the known relationship between cable feed angle and sideboom orientation, electronic control unit 74 can determine an angle of sideboom 28 relative to a horizontal reference plane or some other reference. In this general manner, electronic control unit 74 monitors orientation of hoisting cable 43 and can account for position of machine 10 upon a slope, thus determining whether there is a risk of tipping over of machine 10 when supporting a given load at least when counterweight orientation is also considered, as further discussed herein.

Figure 4:
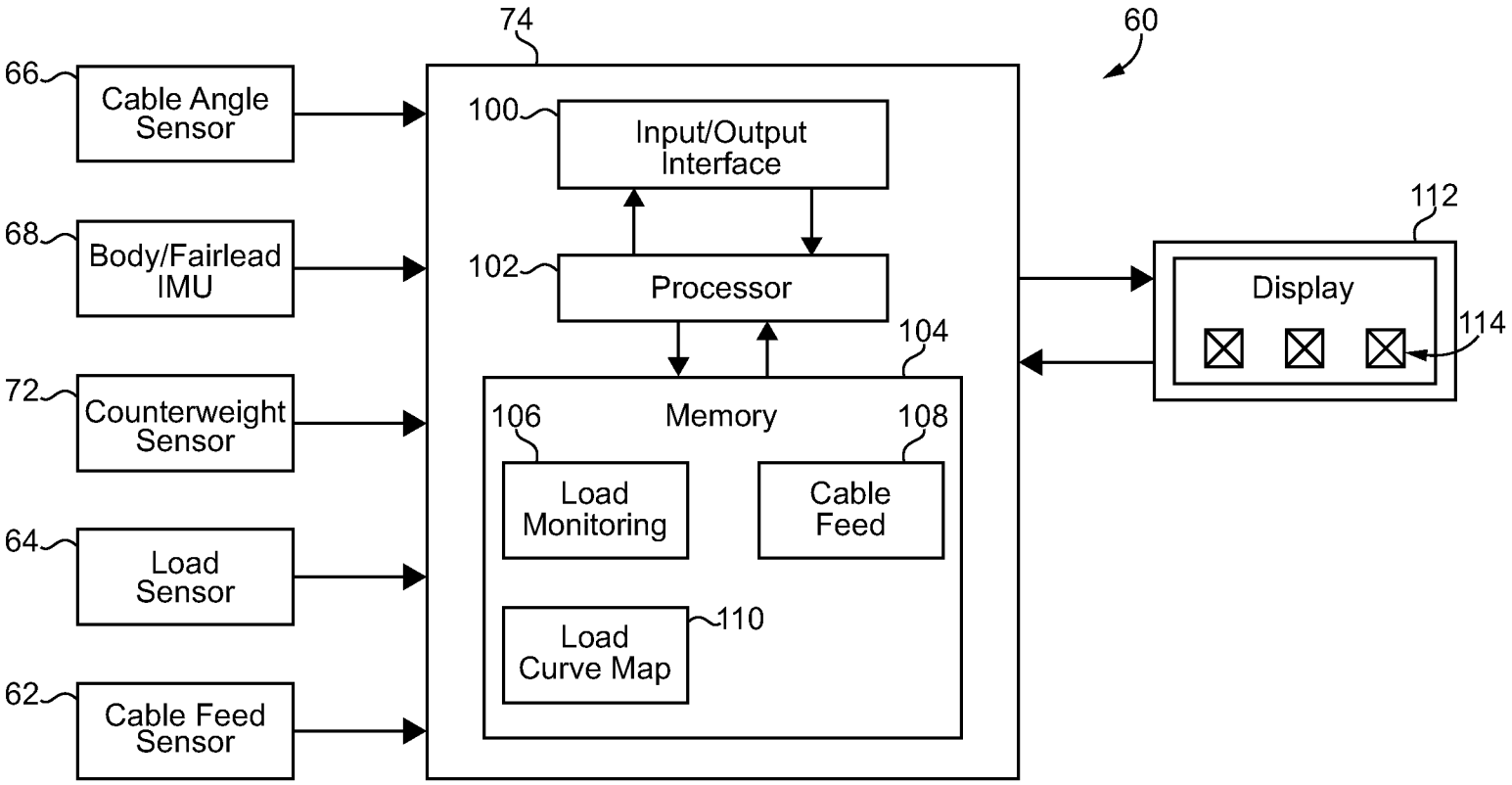
FIG. 4 is a block diagram of a control system, according to one embodiment.

Referring also now to FIG. 4, there are shown components of control system 60 in an example arrangement. Electronic control unit 74 includes an input/output interface 100, for receiving inputs from various sensors and sending outputs in the nature of control commands, monitored quantities or qualities, and condition alerts as further discussed herein. Sensors 62, 64, 66, 68, 72 are shown coupled with electronic control unit 74 to provide cable monitoring data, machine/frame monitoring data, and counterweight monitoring data as the case may be, in the form of sensor signals, as described herein. Electronic control unit 74 further includes a processor 102, which can include any suitable central processing unit such as a microcontroller or a microprocessor. Processor 102 is in communication with a memory 104 that stores computer executable program instructions in the nature of a load monitoring program or control routine 106 and a cable feed program or control routine 108, as also further discussed herein. Memory 104 can include RAM, ROM, a hard drive, Flash, SDRAM, EEPROM, or still another type of memory. A load curve map is shown at 110 and is referenced by program 106 to determine a load condition of machine 10, such as an overload condition or likely overload condition, and generate appropriate alerts, as further discussed herein. A display 112, which may be mounted in or on operator cab 20, can include a graphical user interface such as a touchscreen (not numbered), structured to convey various types of information to an operator, and receive control inputs from an operator. A plurality of alert icons are shown at 114 and represent alerts or warnings that can be presented to an operator by way of illumination, for example. Other operator perceptible alerts such as audible alerts might be used.

Figure 6:
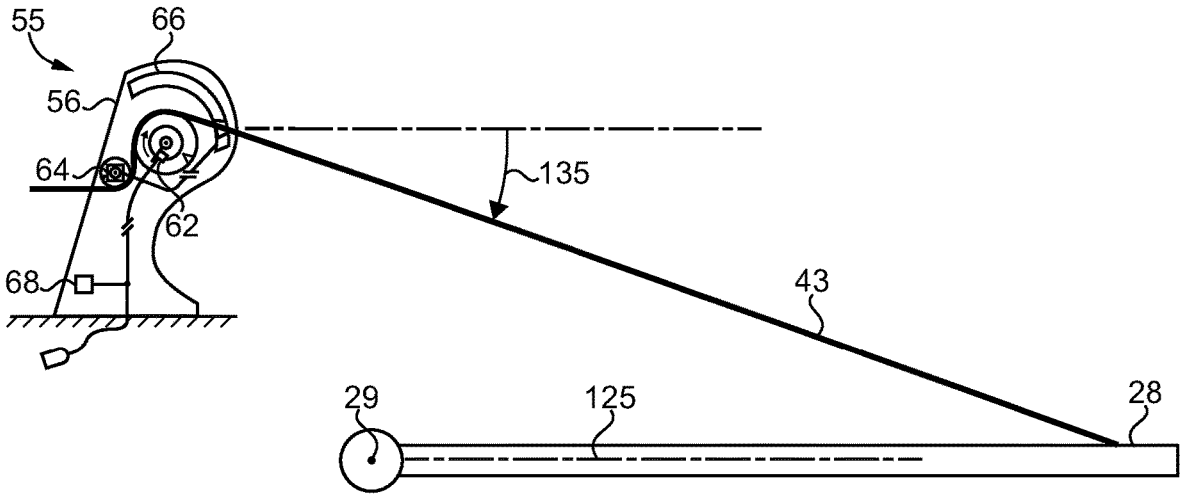
FIG. 6 is a diagrammatic view of parts of a hoisting system in another configuration.

Turning now to FIG. 5, there is shown fairlead system 55 as it might appear where sideboom 28 is at a raised, stowed position. A cable feed angle 135 is defined between hoisting cable 43 and a horizontal reference plane. A boom angle 125 is defined between sideboom 28 and the horizontal reference plane. FIG. 6 illustrates fairlead 55 as it might appear where sideboom 28 is lowered to a substantially horizontal position. In FIG. 6, cable feed angle 135 is shown between hoisting cable 43 and the horizontal reference plane, and angle 125 is equal substantially to zero. Based upon the known relationship or ascertainable relationship between cable feed angle 135 and sideboom angle 125, cable angle measurements by way of cable angle sensor 66 can give a direct and proportional determination. The relationship between cable angle 135 and boom angle 125 can depend upon the relative size/lengths of fairlead 56 and sideboom 28 as well as the positioning of those components in machine 10. In one implementation boom angle 125 could be mapped to cable feed angle 135, whereas in other implementations boom angle 125 could be calculated by way of electronic control unit 74 in real time.

INDUSTRIAL APPLICABILITY

Operating machine 10 can include supporting a pipeline or section of pipeline in cooperation with a plurality of other pipelayer machines. The pipelayer machines can be arranged one after the other next to a prepared trench, with each pipelayer supporting a different pipe section in a roller sling or the like. Operators, or control systems, can raise, lower, and reposition as desired the individual pipe sections to place the pipeline in the trench as the group of machines moves forward. Ground crews can assist the machines with placement, positioning, welding together of adjacent pipe sections, and other support activities. A hoisting cable such as hoisting cable 43 can be guided in each one of the machines between a winch assembly and a boom by way of an instrumented fairlead such as fairlead 56 supported at a fixed orientation relative to the frame of the associated machine.

To position the pipeline sections as desired each machine can pivot its boom between a first boom position and a second boom position relative to the frame. The cable state sensing mechanism comprised of one or more sensors as described herein, resident on the fairlead, can produce cable monitoring data indicative of at least one of a cable feed length, a cable feed angle, or a cable load. Continuous or periodic monitoring will produce cable monitoring data indicative of changes to the at least one of a cable feed length, a cable feed angle, or a cable load that occurs in response to the pivoting of the boom between the first boom position and the second boom position. For example, pivoting sideboom 28 may impart the tendency for upper hook pulley block 44 and lower hook pulley block 46 to vary their relative spacing from one another, depending upon the extent (if any) to which hoisting cable 43 is wound or unwound from winch 42. Analogously, pivoting of sideboom 28 varies cable feed angle and cable load. Based on the cable monitoring data that is indicative of changes to the parameters of interest, electronic control unit 74 can output an alert for display on display 112, for production of an audible alert, for signaling to a site manager or supervisory control system, for data recording purposes, or for still another purpose.

Figure 7:
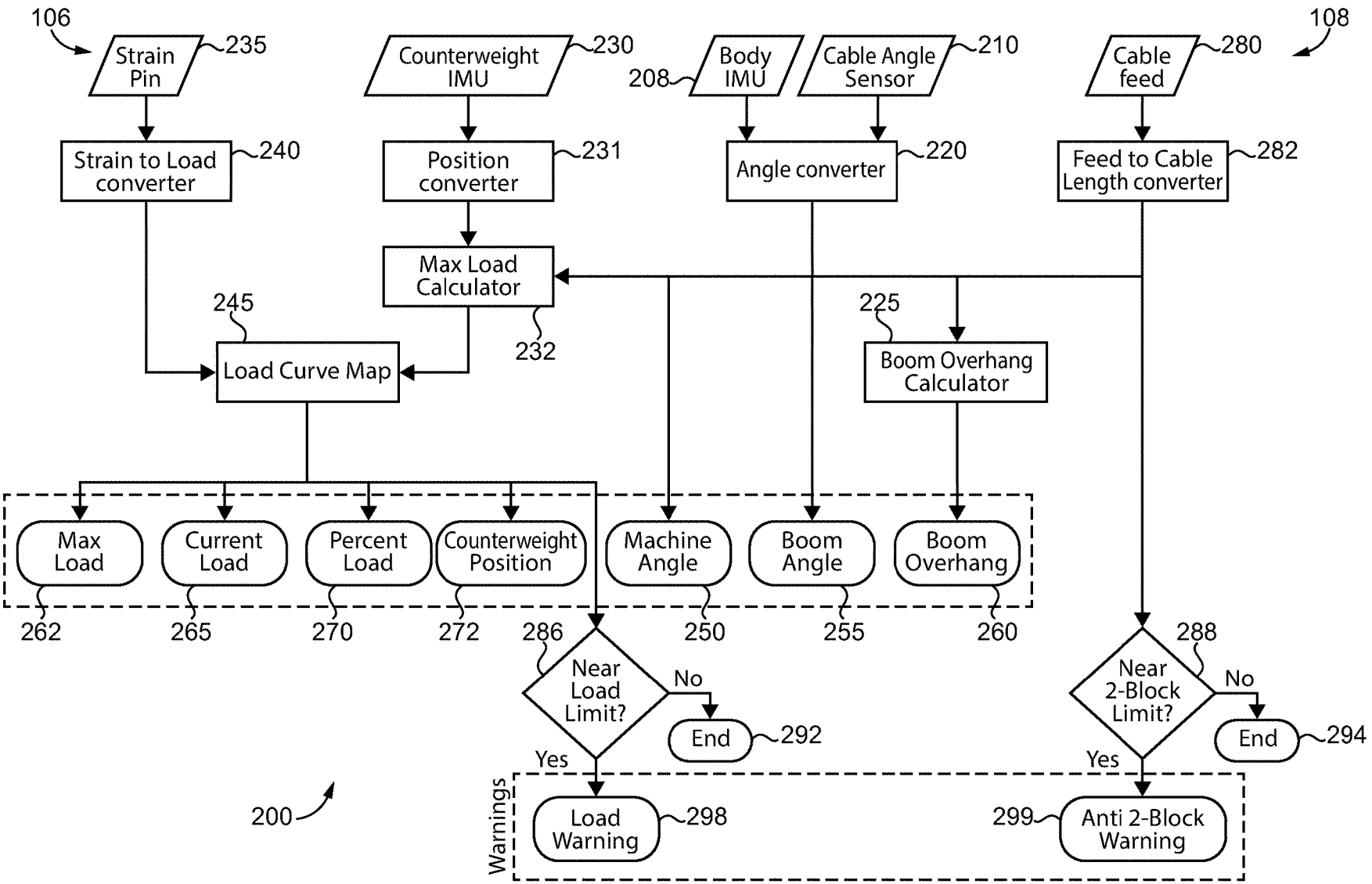
FIG. 7 is a flowchart illustrating example process and control logic flow, according to one embodiment.

Referring now to FIG. 7, there is shown a flowchart 200 illustrating example process and control logic flow corresponding to program 106, and example process and control logic flow corresponding to program 108. It should be appreciated that programs 106 and 108 could be executed as subroutines of the same software program or could run as separate parallel routines, for example. At a block 205 is shown the body IMU (frame sensor 68) that produces data indicative of frame position or orientation, and at a block 210 is shown cable angle sensor 66 that produces data indicative of cable angle. An angle converter is shown at a block 220 whereby electronic control unit 74 calculates an angle of sideboom 28 relative to a reference such as a horizontal reference plane. It will be recalled that cable feed angle varies with sideboom orientation. At a block 225 a boom overhang calculator is shown, which can enable electronic control unit 74 to determine the relative extent to which, or the absolute extent to which, sideboom 28 extends outwardly of frame 12. At a block 230 is shown counterweight IMU, which can monitor a counterweight position (sensor 78). At a block 231 a position converter converts a position signal indicative of counterweight position to a counterweight angle, for example. A max load calculator is shown at 232. At block 232, electronic control unit 74 can determine a max allowable load for a given orientation of fairlead 56, at a given orientation of machine 10/frame 12, and at a given orientation of counterweight 30. As further discussed below, electronic control unit 74 can output an alert based on a current hook load and the determined max allowable load from block 232.

It should also be appreciated that changing a sideboom angle, for instance, can change the max allowable load and justify outputting an alert. For example, an operator might lower sideboom 28 from a first orientation where a given hook load is allowable to a second orientation where the given hook load is not allowable. In such circumstances an overload alert can be output and the operator, or control system 60, could raise sideboom 28, raise counterweight 30, adjust both sideboom 28 and counterweight 30, or take some other action. Machine underfoot conditions could also be a factor in what max allowable loads or other threshold conditions are determined and how those conditions are managed. As suggested above, changes in any of cable feed angle, cable feed length, cable load, or still other parameters can justify outputting an alert, typically, but not necessarily, because relative machine stability and/or likelihood of tipping is changed. In view of the foregoing, it will thus be appreciated that load monitoring and management of overload, pulley block collision, and other machine operating conditions according to the present disclosure can be a dynamic process.

At a block 235 is shown the strain pin, producing the load monitoring signal by way of sensor 64. At a block 240 is depicted a strain to load converter where a strain detected by way of sensor 64 is converted to a load on hoisting cable 43. The determined load on hoisting cable 43 can be converted to a current hook load according to known trigonometric or other computational or inferential techniques, for example. A load curve map is shown at a block 245. At block 245 electronic control unit 74 can compare the max allowable load to a current hook load. The load curve map might include a current hook load coordinate and a max load coordinate. An alternative strategy could include a cable load coordinate, a fairlead boom angle coordinate, a max load coordinate, and/or a counterweight angle coordinate. Still other map configurations could be used.

Several of the blocks in flowchart 200 represent information that can be displayed on display 112 to an operator. Machine angle is shown at a block 250 and can represent machine angle as determined on the basis of data from frame sensor 68. Boom angle is shown at a block 255 and can display to an operator an angle of sideboom 28 relative to a horizontal reference plane, or relative to some other reference such as frame 12. At a block 260, boom overhang is displayed. At a block 262, the max load determined at max load calculator 232 is displayed. At a block 265, the current hook load on hoisting cable 43 is displayed. Block 270 displays a percent load, meaning a percent of max allowable load that is currently applied to hoisting cable 43. At a block 272 counterweight position is displayed.

At a block 280 of program 108 is shown cable feed or cable feeding data produced by cable feed sensor 66. At a block 282 is shown a feed-to-cable length converter where, for example, a number of pulley rotations is converted to a cable length. At a block 288, it is queried whether conditions are near the 2-block limit, based on determined locations of hook blocks 44 and 46 as described herein. If no, the control routine can end or exit at a block 294. If yes, the control routine can advance to a block 299 to output an anti-2-block warning or pulley collision alert. At a block 286 electronic control unit 74 can receive the load on hoisting cable 43 and query whether conditions are near a load limit? If no, the control routine can advance to a block 292 to end or exit. If yes, the control routine can advance to a block 298 to produce the load warning or overload alert.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A machine comprising:

a frame;

a hoisting system coupled to the frame and including a winch assembly, and a boom movable by pivoting between a first boom position, and a second boom position at which the boom extends outboard of the frame;

the hoisting system further including a fairlead, and a hoisting cable extending through the fairlead from the winch assembly to the boom;

the fairlead being supported at a fixed orientation relative to the frame, such that a feed angle of the hoisting cable between the fairlead and the boom varies in response to the pivoting of the boom between the first boom position and the second boom position; and a hoisting control system including a cable state sensing mechanism resident on the fairlead and structured to produce cable monitoring data indicative of at least one of a cable feed length, a cable feed angle, or a cable load, and an electronic control unit coupled with the cable state sensing mechanism and structured to output an alert based on the cable monitoring data.

2. The machine of claim 1 further comprising a plurality of ground-engaging elements coupled to the frame, and wherein the frame includes a front frame end and a back frame end and the boom includes a sideboom coupled to the frame between the front frame end and the back frame end.

3. The machine of claim 2 further comprising an operator cab coupled to the frame, and wherein the fairlead is supported at the fixed orientation at a fairlead mounting location longitudinally between the front frame end and the back frame end, latitudinally between the winch assembly and the sideboom, and both forward and outboard of the operator cab.

4. The machine of claim 1 wherein the fairlead further includes a plurality of feed pulleys and the hoisting cable extends about the plurality of feed pulleys in a serpentine pattern.

5. The machine of claim 4 wherein the cable state sensing mechanism includes a cable angle sensor, and the electronic control unit is further structured to determine an angle of the boom based on cable monitoring data produced by the cable angle sensor.

6. The machine of claim 5 wherein the cable state sensing mechanism includes a load sensor, and the electronic control unit is further structured to determine a hook load based on cable monitoring data produced by the load sensor.

7. The machine of claim 6 wherein one of the plurality of feed pulleys includes a pulley pin, and the load sensor includes a strain gauge coupled with the pulley pin.

8. The machine of claim 6 wherein the electronic control unit is further structured to compare the hook load with a max allowable load, and the alert includes an overload alert that is based on the comparing of the hook load with the max allowable load.

9. The machine of claim 4 wherein the cable state sensing mechanism includes a cable feeding sensor, and the electronic control unit is further structured to determine a cable feed length through the fairlead based on cable monitoring data produced by the cable feeding sensor.

10. The machine of claim 9 wherein the hoisting system further includes an upper hook pulley block supported by the boom and a lower hook pulley block suspended by the hoisting cable, and the alert includes a block collision alert that is based on cable monitoring data produced by the cable feeding sensor.

* * * * *